US005330177A

United States Patent [19]

Rogge

[11] Patent Number: 5,330,177

[45] Date of Patent: Jul. 19, 1994

[54] GOLF TEE SET APPARATUS

[76] Inventor: Mark Rogge, 3112 134th Ave. NE., Lake Stevens, Wash. 98258

[21] Appl. No.: 88,378

[22] Filed: Jul. 9, 1993

[51] Int. Cl.[5] ..... A63B 57/00

[52] U.S. Cl. ..... 273/32.5; 273/32 B; 273/32 D; 294/19.2

[58] Field of Search ..... 273/32.5, 32 F, 32 B, 273/33, 162 E, 162 F; 294/119.1, 19.2

[56] References Cited

U.S. PATENT DOCUMENTS

| | | | |
|---|---|---|---|
| 1,175,035 | 3/1916 | Wooster | 294/19.2 |
| 1,452,679 | 4/1923 | Fisher | 294/19.2 |
| 4,013,295 | 3/1977 | Baughman | 273/32.5 |
| 4,616,826 | 10/1986 | Trefts | 273/32.5 |
| 4,693,473 | 9/1987 | Miller | 273/32 F |
| 4,714,250 | 12/1987 | Henthorn | 273/32.5 |
| 4,819,938 | 4/1989 | Hill | 273/32 B |
| 4,949,961 | 8/1990 | Milano | 273/32.5 |
| 5,004,239 | 4/1991 | Wettstein | 273/32 B |

*Primary Examiner*—Vincent Millin
*Assistant Examiner*—Steven B. Wong
*Attorney, Agent, or Firm*—E. Michael Combs

[57] ABSTRACT

A golf ball and tee set includes cooperative first and second jaw legs arranged to secure a golf ball and tee member, wherein an outer sleeve is cooperative with a support post, wherein displacement of the sleeve relative to the support post effects closure of the first and second jaw legs to provide for cooperative conical recesses and bores to secure the golf tee, with the golf ball secured between the legs positioned over the golf tee. A modification of the invention is arranged to include a golf ball cleaning structure mounted to the sleeve to provide for pre-cleaning of the golf ball prior to use.

3 Claims, 5 Drawing Sheets

GOLF TEE SET APPARATUS

BACKGROUND OF THE INVENTION

1. Field of the Invention

The field of invention relates to golf apparatus, and more particularly pertains to a new and improved golf tee set apparatus wherein the same is arranged for the ease of directing a golf ball and tee into an underlying turf.

2. Description of the Prior Art

Golf ball set structure is indicated and exemplified by the U.S. Pat. Nos. 4,714,250 and 4,949,961.

The instant invention attempts to overcome deficiencies of the prior art by providing for a compact, readily operative construction arranged for ease of use as well as effectiveness in construction and in this respect, the present invention substantially fulfills this need.

SUMMARY OF THE INVENTION

In view of the foregoing disadvantages inherent in the known types of golf ball and tee set apparatus now present in the prior art, the present invention provides a golf tee set apparatus wherein the same is directed for the clamping and securement of a golf ball and tee for its insertion within turf permitting ease of release of the golf ball and tee structure subsequent to the setting procedure. As such, the general purpose of the present invention, which will be described subsequently in greater detail, is to provide a new and improved golf tee set apparatus which has all the advantages of the prior art golf tee set apparatus and none of the disadvantages.

To attain this, the present invention provides a golf ball and tee set including cooperative first and second jaw legs arranged to secure a golf ball and tee member, wherein an outer sleeve is cooperative with a support post, wherein displacement of the sleeve relative to the support post effects closure of the first and second jaw legs to provide for cooperative conical recesses and bores to secure the golf tee, with the golf ball secured between the legs positioned over the golf tee. A modification of the invention is arranged to include a golf ball cleaning structure mounted to the sleeve to provide for pre-cleaning of the golf ball prior to use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf tee set apparatus which has all the advantages of the prior art golf tee set apparatus and none of the disadvantages.

It is another object of the present invention to provide a new and improved golf tee set apparatus which may be easily and efficiently manufactured and marketed.

It is a further object of the present invention to provide a new and improved golf tee set apparatus which is of a durable and reliable construction.

An even further object of the present invention is to provide a new and improved golf tee set apparatus which is susceptible of a low cost of manufacture with regard to both materials and labor, and which accordingly is then susceptible of low prices of sale to the consuming public, thereby making such golf tee set apparatus economically available to the buying public.

Still yet another object of the present invention is to provide a new and improved golf tee set apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
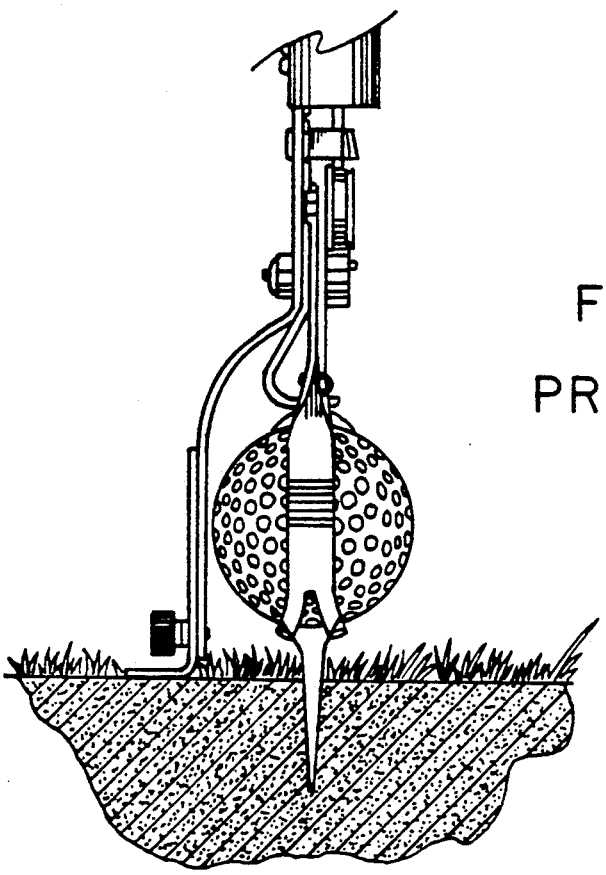
FIG. 1 PRIOR ART
FIG. 1 is an orthographic view of a prior art golf ball and tee set structure, as indicated in U.S. Pat. No. 4,949,961.
Figure 2:
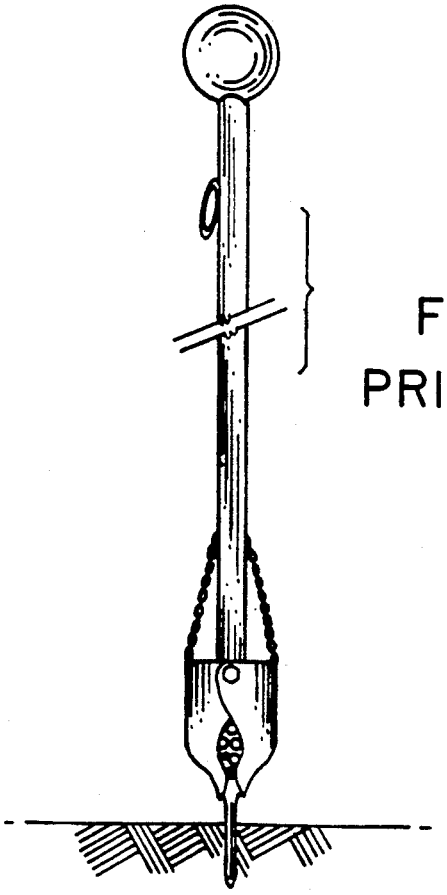
FIG. 2 PRIOR ART
FIG. 2 is an orthographic view of a further example of a prior art golf and tee set structure, as indicated in U.S. Pat. No. 4,714,250.
Figures 3, 3A:
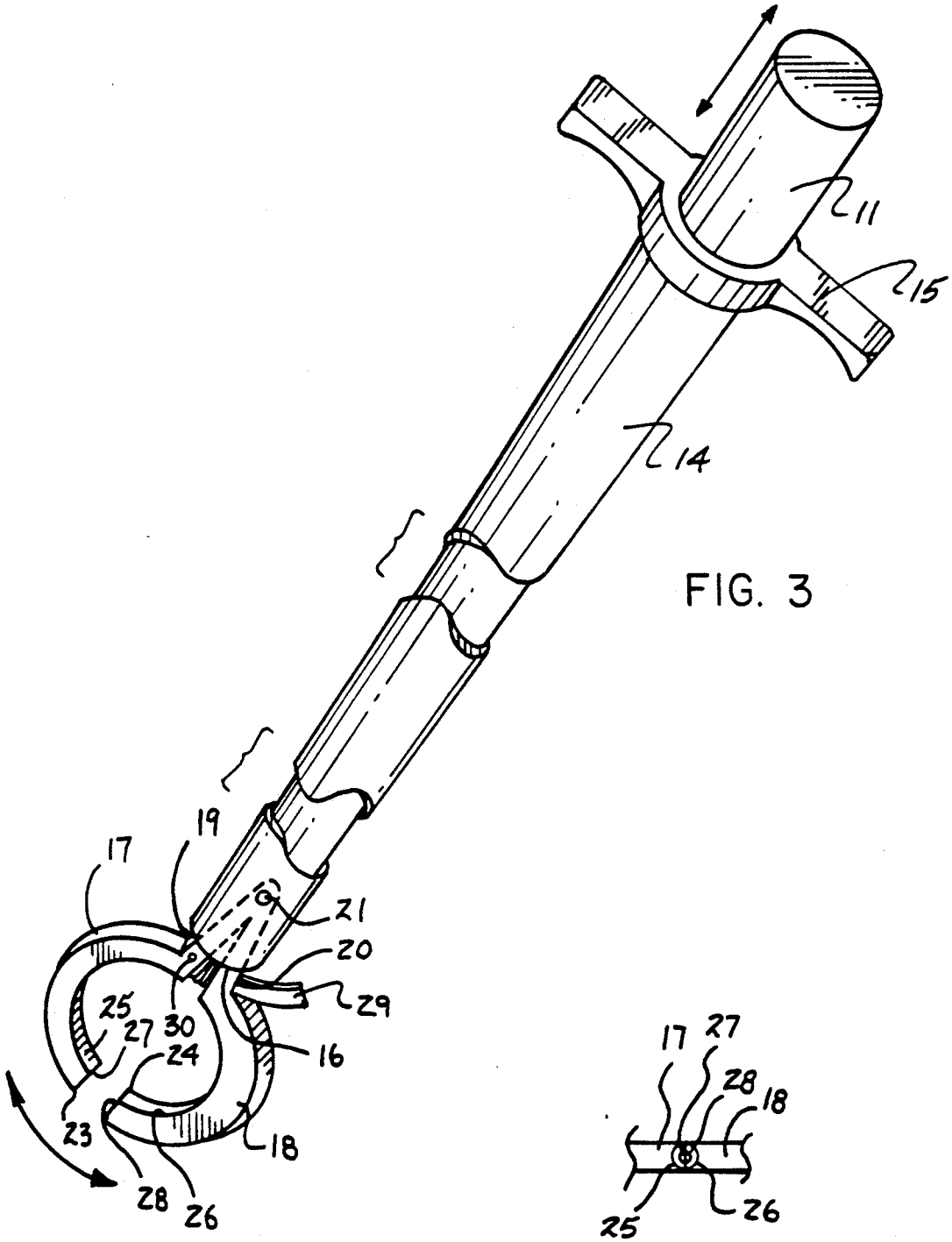
FIG. 3 is an isometric illustration of the invention.
FIG. 3*a* is an orthographic top view indicating the alignment of the cooperative conical recess and bore structure of the cooperative jaws of the invention.

With reference now to the drawings, and in particular to FIGS. 1 to 9 thereof, a new and improved golf tee set apparatus embodying the principles and concepts of the present invention and generally designated by the reference numerals 10 and 10*a* will be described.

More specifically, the golf tee set apparatus 10 of the instant invention essentially comprises a support post 11, having a post first end spaced from a post second end 12 and 13 respectively, with an actuator sleeve 14 slidably receiving the support post 11 therethrough. The actuator sleeve includes a sleeve first end handle 15 mounted orthogonally and fixedly to the actuator sleeve first end, with an actuator sleeve second end 16 having sliding engagement of respective first and second jaw legs 19 and 20 of respective semi-circular first and second jaws 17 and 18. A jaw leg axle 21 is mounted within the support post 11 within a support post socket 22 directed into the support post second end 13. A first jaw free end and a second jaw free end 23 and 24 (see FIG. 3) are arranged in a facing confronting relationship such that upon contiguous communication of the first and second jaw free ends 23 and 24, first and second conical recesses 25 and 26 respectively of the first and second jaw free ends 23 and 24 are arranged in a mirror image facing relationship relative to one another in cooperation with respective first and second semi-cylindrical bores 27 and 28 of the first and second jaw free ends 23 and 24 that are in communication with the first and second conical recesses 25 and 26 to provide for a conical recess 25 to receive the head of a golf tee, with the golf tee shaft directed through the cooperative resulting bore of the first and second cooperative semi-cylindrical bores 27 and 28 (see FIG. 5). A guide leg 29 is slidably received through the second jaw leg 20 and pivotally mounted to the first jaw leg 19 at a guide leg axle 30, with the guide leg 29 slidably received through the second jaw leg 20 in adjacency to the second jaw 18, while the guide leg axle 30 is oriented in adjacency relative to the first semi-circular jaw 17, with a guide leg spring 31 wound about the guide leg 29 and captured between the first and second jaw legs 19 and 20, in a manner as exemplified in the FIG. 4.

Figures 4, 5:
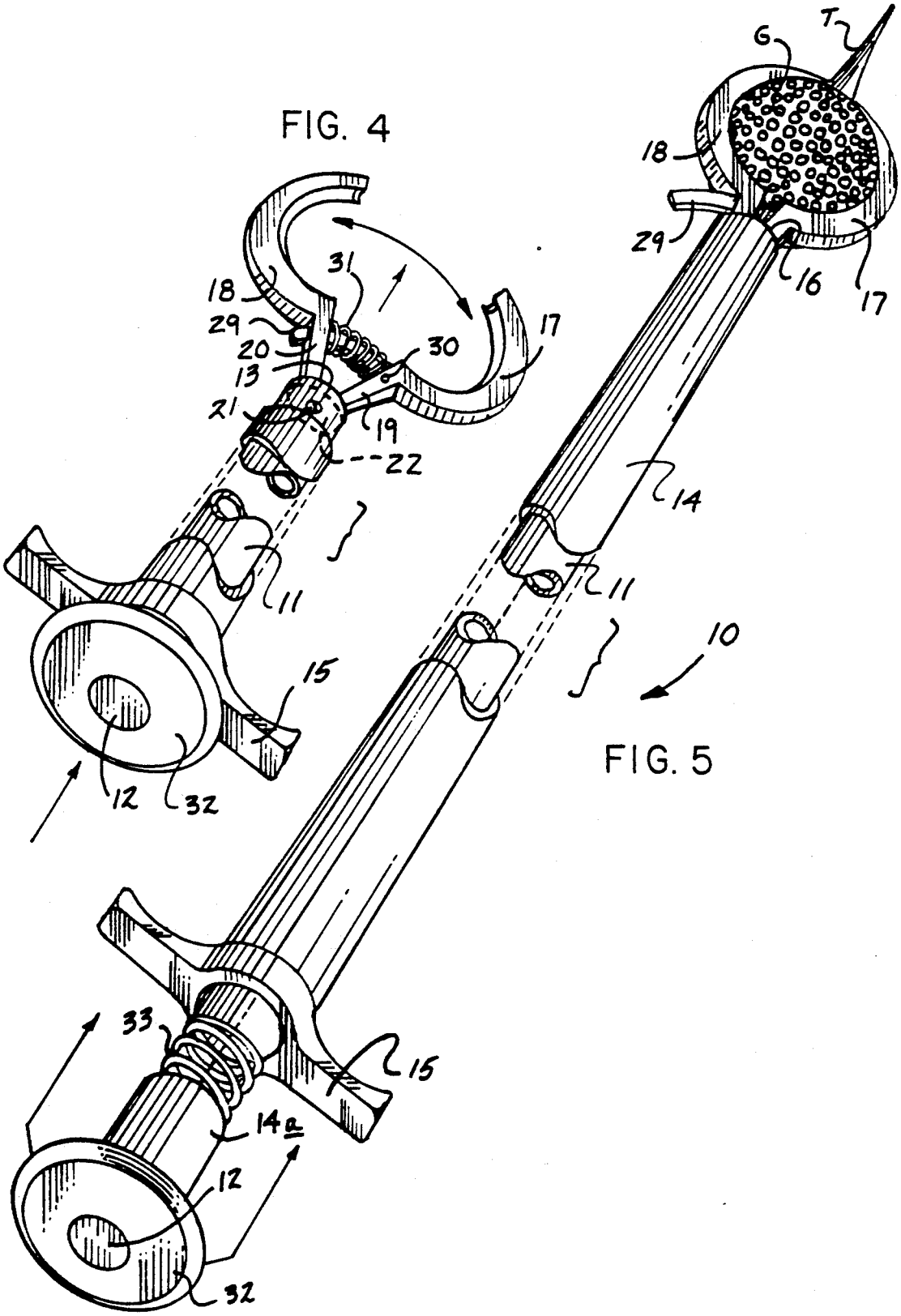
FIG. 4 is an isometric illustration, partially in section, of the invention indicating the use of a head member arranged for mounting to the support post of the invention.
FIG. 5 is an isometric illustration of the invention.
Figure 6:
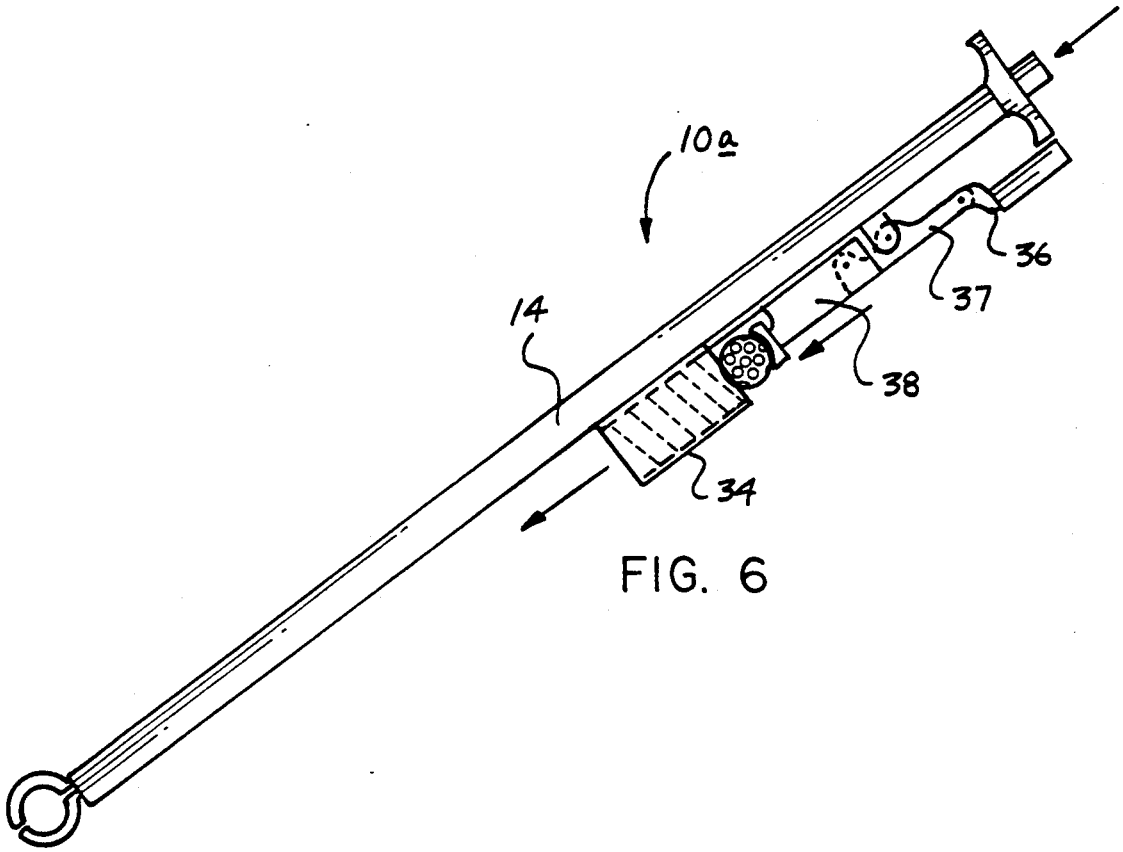
FIG. 6 is an orthographic view indicating the use of a golf ball cleaning structure mounted to the sleeve structure.
Figure 7:
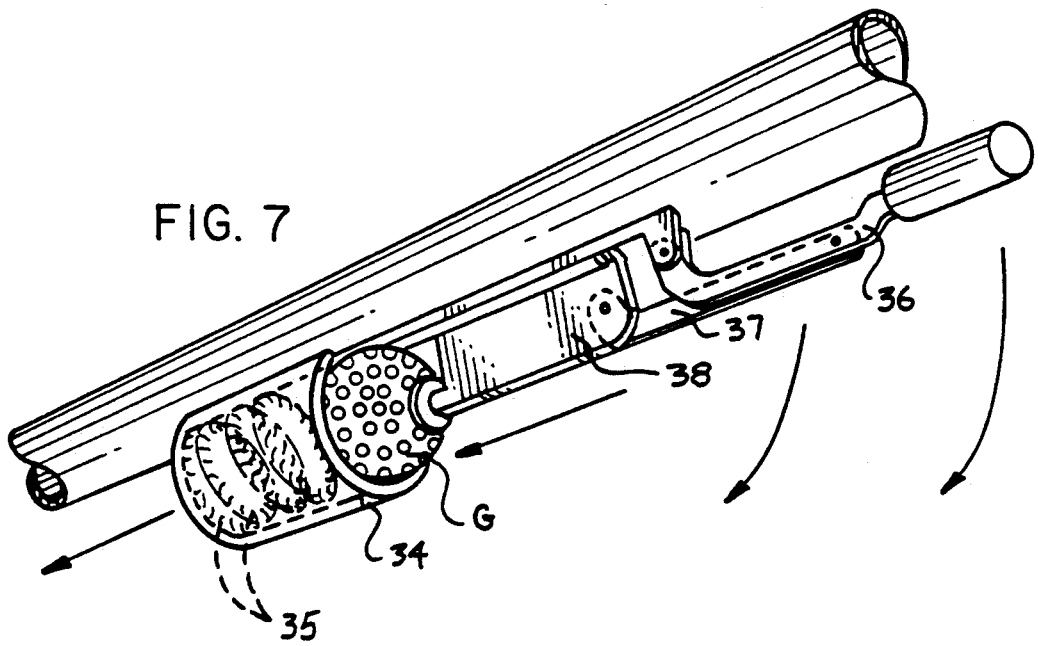
FIG. 7 is an isometric illustration of the golf ball cleaning structure.
Figure 8:
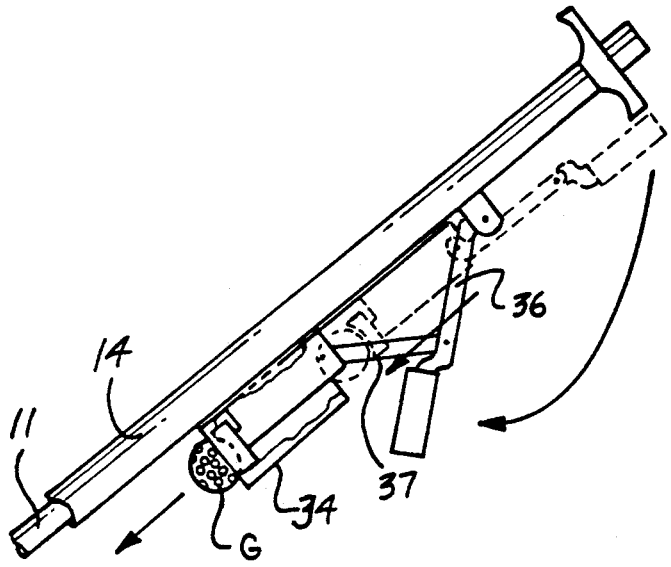
FIG. 8 is an orthographic view of the golf ball cleaning structure arranged in an illustrative manner to direct the golf ball therethrough.
Figure 9:
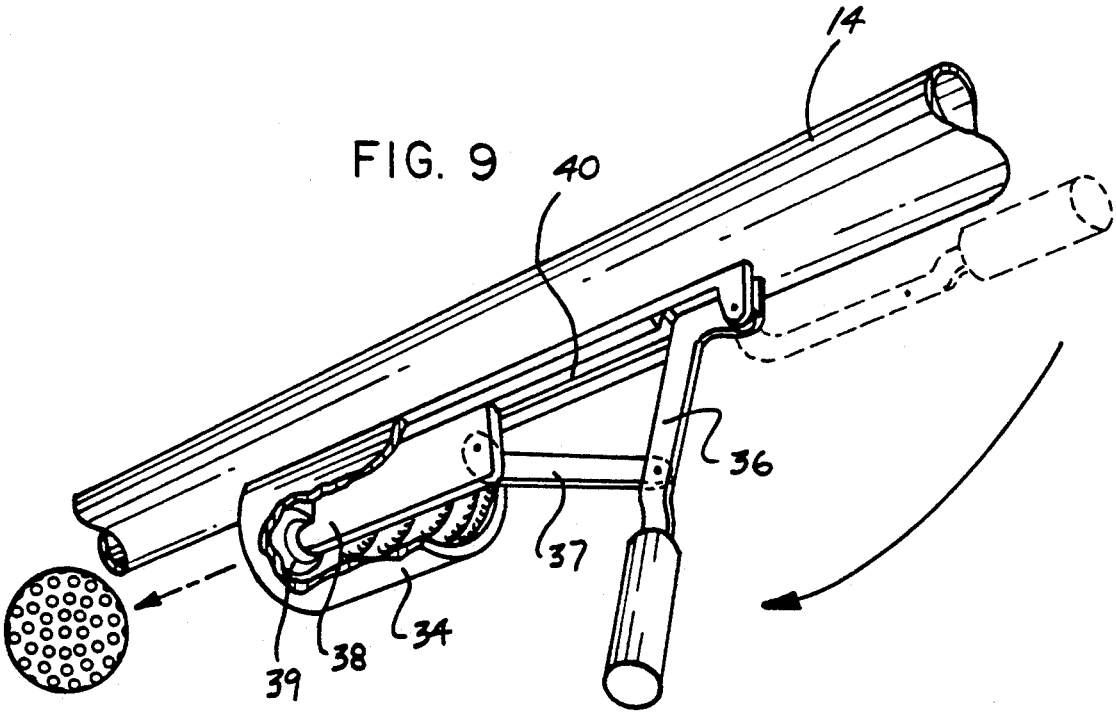
FIG. 9 is an isometric illustration of the golf ball cleaning structure projecting the golf ball therethrough.

The FIG. 5 indicates further a sleeve head 32 mounted to the support post first end 12, having a sleeve cap 14*a* spaced from the sleeve first end handle 15 such that a support post spring 33 is directed around the support post 11 between the sleeve cap 14*a* and the first end handle 15 to effect initial spacing and biasing of the sleeve relative to the sleeve cap, whereupon projecting the sleeve cap towards the first end handle 15 directs the sleeve 14, and more specifically the sleeve second end 16, over the first and second jaw legs 19 and 20 to direct the jaw legs together compressing simultaneously the guide leg spring 31 and in this manner, securing the golf ball "G" and the golf tee "T" within the first and second jaw legs 19 and 20, as illustrated in FIG. 5.

The apparatus 10*a*, as exemplified in the FIGS. 6–9, includes a cleaning sleeve 34 fixedly mounted to the sleeve 14, having spaced brushes 35 directed therewithin, with an actuator handle 36 provided pivotally mounted to the sleeve 14 and spaced from the cleaning sleeve 34, with an actuator handle link 37 pivotally mounted to the actuator handle 36, with the link pivotally mounted to an actuator slide 38. The slide 38 includes a ram head 39. The ram slide 38 is slidably mounted within a guide track 40 that is arranged in a parallel relationship relative to an axis of the sleeve 34, with the axis of the sleeve 34 coaxially aligned with the ram head 39 to direct a golf ball "G" through the brushes 35, in a manner as illustrated in the FIGS. 7–9 for example, to provide for initial cleaning of the golf ball prior to its mounting within the first and second jaws 17 and 18, such as exemplified in the FIG. 5.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf tee set apparatus, comprising, a support post, the support post having a post first end spaced from a post second end, and an actuator sleeve, the sleeve having a first end, having a first end handle fixedly mounted to the sleeve first end, and a sleeve second end spaced from the sleeve first end, and a first semi-circular jaw and a second semi-circular jaw, with the first jaw and the second jaw having a respective first jaw leg and a second jaw leg extending from the first jaw and the second jaw, and the first jaw including a first jaw free end spaced from the first jaw leg, and the second jaw having a second jaw free end spaced from the second jaw leg, the first jaw leg and the second jaw leg pivotally mounted about a jaw leg axle, and the jaw leg axle mounted pivotally relative to the support post, with the first jaw leg and the second jaw leg arranged in adjacency to and reception within the sleeve second end, and the first jaw free end and the second jaw free end arranged in a facing confronting relationship to secure a golf tee therebetween, the first jaw and the second jaw are arrange for reception of a golf ball therebetween, whereupon projection of the actuator sleeve second end over the first jaw leg and the second jaw leg effects projection of the first jaw free end towards the second jaw free end in a contiguous communication relative to one another, and a guide leg, having a guide leg axle pivotally mounted to the first jaw leg in adjacency to the first jaw, and the guide leg slidably directed through the second jaw leg in adjacency to the second jaw, with a guide leg spring wound about the guide leg and captured between the first jaw leg and the second jaw leg to normally bias the first jaw in a spaced relationship relative to the second jaw.

2. An apparatus as set forth in claim 1 including a cleaning sleeve mounted to the actuator sleeve between the sleeve first end and the sleeve second end, the cleaning sleeve having a plurality of brushes therewithin, with an actuator handle pivotally mounted to the actuator sleeve spaced from the cleaning sleeve, with the actuator handle including an actuator handle link, and the actuator handle link including a ram slide pivotally mounted to the actuator handle link, and a guide track fixedly mounted to the actuator sleeve slidably receiving and guiding the ram slide therewithin, with the ram slide including a ram head mounted to the ram slide spaced from the actuator link to direct a golf ball through the sleeve.

3. An apparatus as set forth in claim 2 wherein the guide track extends through the cleaning sleeve, and the cleaning sleeve symmetrically oriented about a sleeve axis, and the guide track is arranged parallel to the sleeve axis.

* * * * *